US009273898B2

(12) United States Patent
Kwon

(10) Patent No.: US 9,273,898 B2
(45) Date of Patent: Mar. 1, 2016

(54) DEVICE FOR DETECTING ABNORMALITY IN REFRIGERATION CYCLE OF REFRIGERATOR AND METHOD THEREFOR

(71) Applicant: Dongbu Daewoo Electronics Corporation, Seoul (KR)

(72) Inventor: Won Joo Kwon, Incheon (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 175 days.

(21) Appl. No.: 14/116,699

(22) PCT Filed: Apr. 3, 2013

(86) PCT No.: PCT/KR2013/002767
§ 371 (c)(1),
(2) Date: Nov. 8, 2013

(87) PCT Pub. No.: WO2013/151328
PCT Pub. Date: Oct. 10, 2013

(65) Prior Publication Data

US 2014/0305143 A1 Oct. 16, 2014

(30) Foreign Application Priority Data

Apr. 4, 2012 (KR) ..... 10-2012-0035156

(51) Int. Cl.

| | |
|---|---|
| ***G01K 13/00*** | (2006.01) |
| ***F25D 3/12*** | (2006.01) |
| ***F25D 29/00*** | (2006.01) |
| ***F25B 49/00*** | (2006.01) |
| ***F25B 5/02*** | (2006.01) |

(52) U.S. Cl.
CPC ..... *F25D 29/008* (2013.01); *F25B 5/02* (2013.01); *F25B 49/005* (2013.01); *F25B 2700/21174* (2013.01)

(58) Field of Classification Search
CPC .... F25B 49/00; F25B 2500/19; F25B 49/005; F25B 5/02; F25B 2700/21174; F25B 49/02; F25D 29/008
USPC ..... 62/129
See application file for complete search history.

(56) References Cited

U.S. PATENT DOCUMENTS

| | | | | |
|---|---|---|---|---|
| 6,923,016 | B2 * | 8/2005 | Funakoshi et al. | 62/324.1 |
| 7,641,382 | B2 * | 1/2010 | Izawa et al. | 374/4 |
| 2005/0086952 | A1 | 4/2005 | Nonaka et al. | |
| 2005/0217292 | A1 * | 10/2005 | Onishi et al. | 62/197 |

FOREIGN PATENT DOCUMENTS

| | | |
|---|---|---|
| JP | 2003-090654 | 3/2003 |
| JP | 2005-207666 | 8/2005 |
| JP | 2007-107815 | 4/2007 |
| KR | 10-0257832 | 6/2000 |
| KR | 10-0549060 | 6/2006 |

OTHER PUBLICATIONS

International Search Report; PCT/KR2013/002767; Jun. 25, 2013.

* cited by examiner

*Primary Examiner* — Allen Flanigan
*Assistant Examiner* — Filip Zec

(57) ABSTRACT

The present disclosure relates to a device and method for detecting an abnormality in a refrigeration cycle of a refrigerator that is capable of detecting whether connection pipes disposed between a refrigerant passage valve and a freezer evaporator and between the refrigerant passage valve and a cold room evaporator are blocked and switched.

6 Claims, 5 Drawing Sheets

DEVICE FOR DETECTING ABNORMALITY IN REFRIGERATION CYCLE OF REFRIGERATOR AND METHOD THEREFOR

TECHNICAL FIELD

The present invention relates to a device and method for detecting an abnormality in a refrigeration cycle of a refrigerator, and more particularly, to a device and method for detecting an abnormality in a refrigeration cycle of a refrigerator that is capable of detecting whether connection pipes are blocked and switched.

BACKGROUND ART

Generally, while a refrigerator is operating, if it is changed to a cooling mode, refrigerant, which produces cool air through heat exchange with the air around a cooling room using an evaporator in the cooling room, is sent to a compressor located in a machine room and then compressed.

Further, the refrigerant, which has a high temperature and high pressure state through the compressor, is passed through a condenser, and the heat of the refrigerant is discharged to the outside. After that, the refrigerant is liquefied and passed through a dryer, and thus, impurities and water from the refrigerant are removed. In this state, the refrigerant is passed through an expansion valve and an evaporator, thereby causing vaporization therefrom, and accordingly, the refrigerant is vaporized by removing the latent heat of vaporization from the air around the cooling room, thereby producing cool air therefrom.

The liquid refrigerant not vaporized yet is passed through an accumulator in a low temperature and low pressure state, thereby providing a refrigeration cycle in which the refrigerant circulation, during which the liquid stays and the gas is introduced again to the compressor, is repeatedly performed.

On the other hand, as shown in FIG. 1, two evaporators 110 and 120 independently control a freezer room and a cold room in a refrigerator having the above-mentioned refrigeration cycle, and a refrigerant passage valve 500 is needed to connect the two evaporators 110 and 120 to one compressor.

The refrigerant passage valve 500 is connected to a dryer 400 and serves to send the refrigerant to the two evaporators 110 and 120, respectively.

Accordingly, the refrigerant passage valve 500 includes one inlet pipe and two outlet pipes, and the two outlet pipes are connected to capillary tubes connected to the two evaporators 110 and 120.

When the outlet pipes of the refrigerant passage valve 500 and the capillary tubes of the evaporators 110 and 120 are normally connected to each other, the refrigerator operates normally, but if the connection pipes are switched, the refrigerator operates abnormally.

To prevent the connection pipes from being switched, the colors of the connection pipes correspond to each evaporator, but when the connection pipes are changed erroneously, until now, there is no method for checking the switched connection pipes.

DISCLOSURE

Technical Problem

Accordingly, the present invention has been made in view of the above-mentioned problems occurring in the prior art, and it is an object of the present invention to provide a device and method for detecting an abnormality in a refrigeration cycle of a refrigerator that is capable of easily detecting whether connection pipes in the refrigeration cycle are normally disposed, without any change, and especially whether a refrigerant passage valve is normally connected to an evaporator.

Technical Solution

To accomplish the above object, according to an aspect of the present invention, there is provided a device for detecting an abnormality in a refrigeration cycle of a refrigerator, the device including a freezer evaporator temperature sensor and a cold room evaporator temperature sensor mounted on connection pipes between a refrigerant passage valve connected to a dryer and a freezer evaporator and between the refrigerant passage valve and a cold room evaporator to detect the temperature of refrigerant from the refrigerant passage valve; and a controller adapted to calculate rates of temperature change from the temperatures measured from the freezer evaporator temperature sensor and the cold room evaporator temperature sensor, to compare the calculated rates of temperature change with previously set rates of temperature change with respect to time in the freezer evaporator and the cold room evaporator, and to determine whether the compared rates correspond to each other.

To accomplish the above object, according to another aspect of the present invention, there is provided a method for detecting an abnormality in a refrigeration cycle of a refrigerator, the method including the steps of (a) if power is applied to a refrigerator, changing an ejection time of refrigerant from a refrigerant passage valve to a freezer evaporator and from that to a cold room evaporator; (b) calculating rates of temperature change with respect to time measured in the freezer evaporator and the cold room evaporator; and (c) comparing the calculated rates of temperature change with previously set rates of temperature change with respect to time in the freezer evaporator and the cold room evaporator and determining whether the abnormality of the refrigeration cycle exists.

According to the present invention, preferably, the step (a) includes the steps of ejecting the refrigerant to the freezer evaporator for a given period of time; and after the same period of time as the refrigerant ejection time to the freezer evaporator has passed, ejecting the refrigerant at the same time to the freezer evaporator and the cold room evaporator.

According to the present invention, preferably, at the time point when the given period of time has passed, if a temperature difference between the temperature measured by a freezer evaporator temperature sensor and an initial temperature is more than a set temperature, and at the time point when the same time as the given period of time has passed, if a temperature difference between the temperature measured by a cold room evaporator temperature sensor and an initial temperature is more than the set temperature, it is determined that the refrigeration cycle for the refrigerator is in a normal state.

According to the present invention, preferably, at the time point when the given period of time has passed, if a temperature difference between the temperature measured by the freezer evaporator temperature sensor and the initial temperature is more than the set temperature, and at the time point when the same time as the given period of time has passed, if a temperature difference between the temperature measured by the cold room evaporator temperature sensor and the initial temperature is less than the set temperature, it is determined that the cold room evaporator is blocked.

According to the present invention, preferably, at the time point when the given period of time has passed, if a temperature difference between the temperature measured by the freezer evaporator temperature sensor and the initial temperature is less than the set temperature, it is determined that the refrigeration cycle for the refrigerator is in a normal state.

According to the present invention, preferably, at the time point when the same time as the given period of time has passed, if a temperature difference between the temperature measured by the freezer evaporator temperature sensor and the initial temperature is more than the set temperature, it is determined that connection pipes are switched, and if the temperature difference thereof is less than the set temperature, it is determined that the freezer evaporator is blocked.

According to the present invention, preferably, at the time point when the same time as the given period of time has passed, if a temperature difference between the temperature measured by the cold room evaporator temperature sensor and the initial temperature is more than the set temperature, it is determined that the freezer evaporator is blocked, and if the temperature difference Δt thereof is less than the set temperature, it is determined that the connection pipes are switched and the cold room evaporator is blocked or no reason is found.

Advantageous Effects

According to the present invention, the device for detecting an abnormality in the refrigeration cycle of the refrigerator is capable of easily detecting whether the connection between the outlet pipe of the refrigerant passage valve and the capillary tube of the evaporator is conducting normally, thereby preventing defects in the refrigerator from occurring due to the abnormality of the refrigeration cycle.

DETAILED DESCRIPTION

Hereinafter, an explanation of a device for detecting an abnormality in a refrigeration cycle of a refrigerator and a method thereof according to the present invention will be given in detail with reference to the attached drawings.

Figure 1:
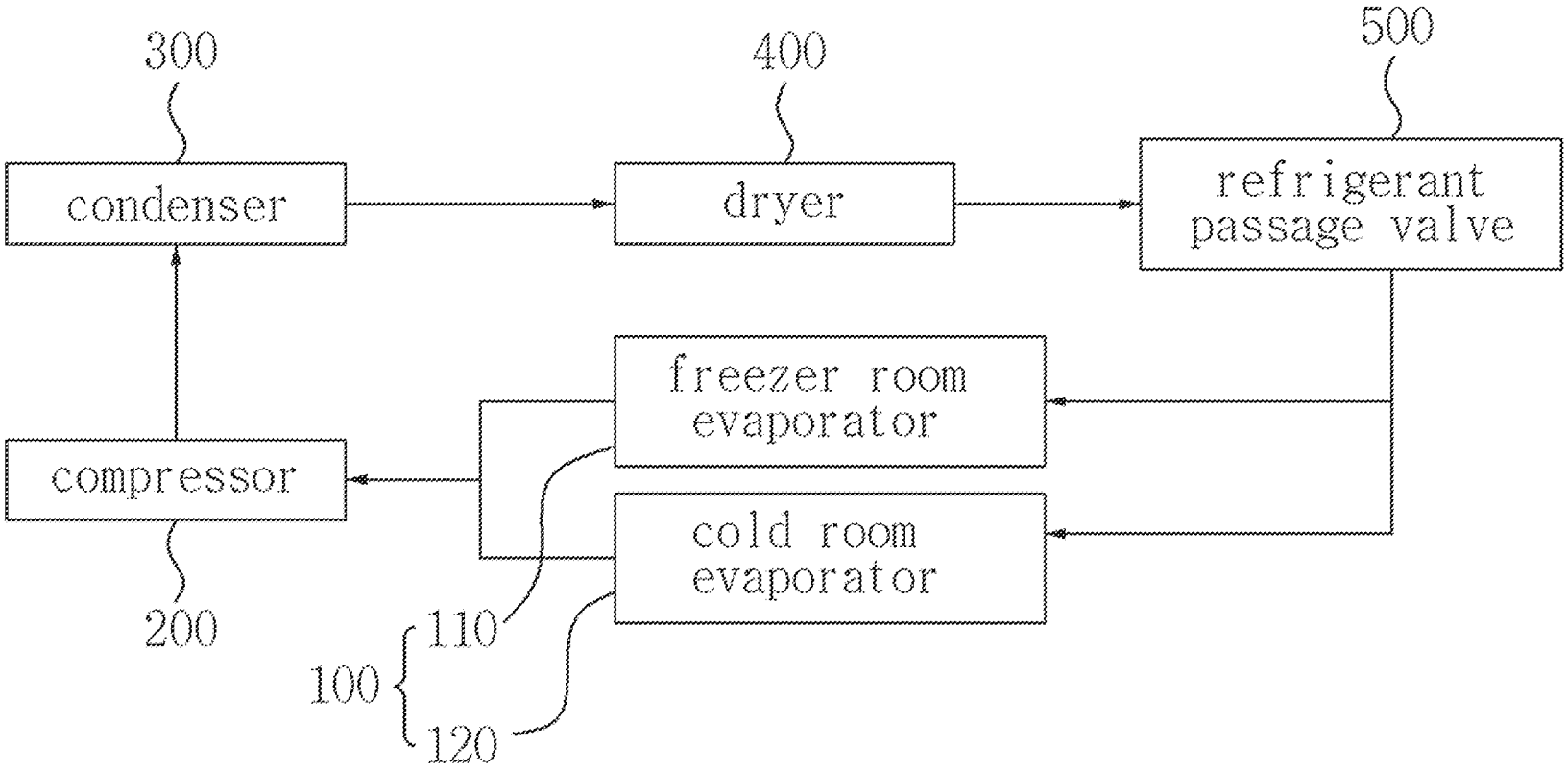
FIG. 1 is a block diagram showing a refrigeration cycle in a refrigerator in a conventional practice.
Figure 2:
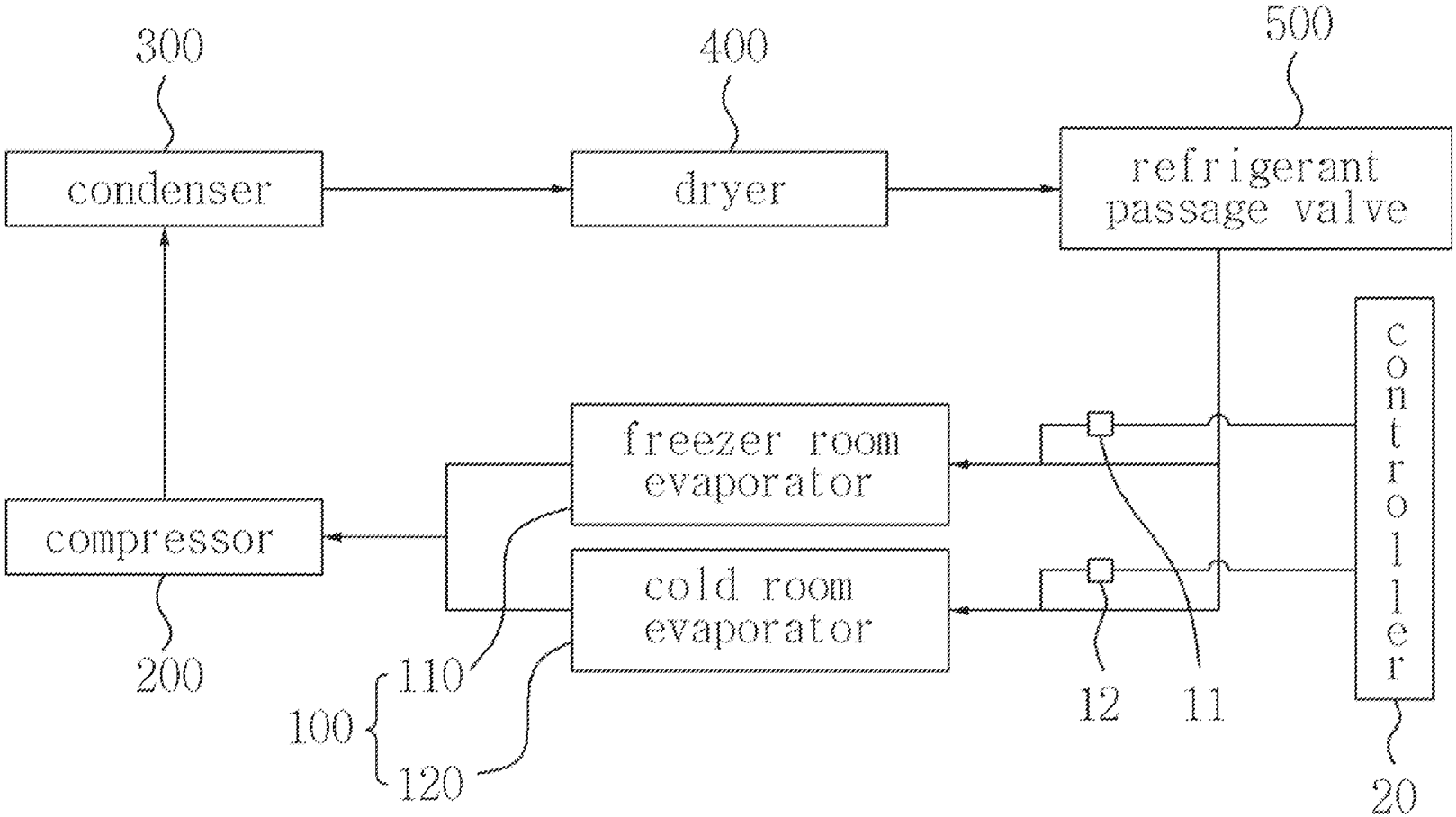
FIG. 2 is a block diagram showing a refrigeration cycle in a refrigerator adopted to the present invention.
Figure 3:
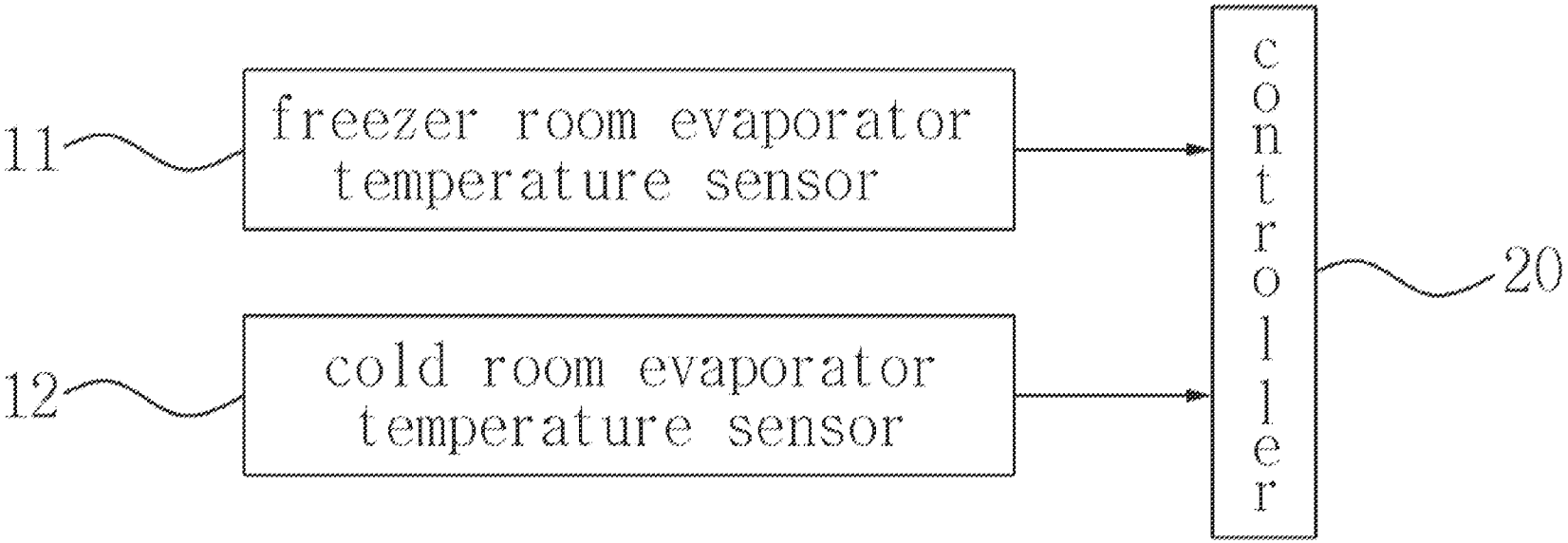
FIG. 3 is a block diagram showing a device for detecting an abnormality in a refrigeration cycle of a refrigerator according to the present invention.
Figure 4:
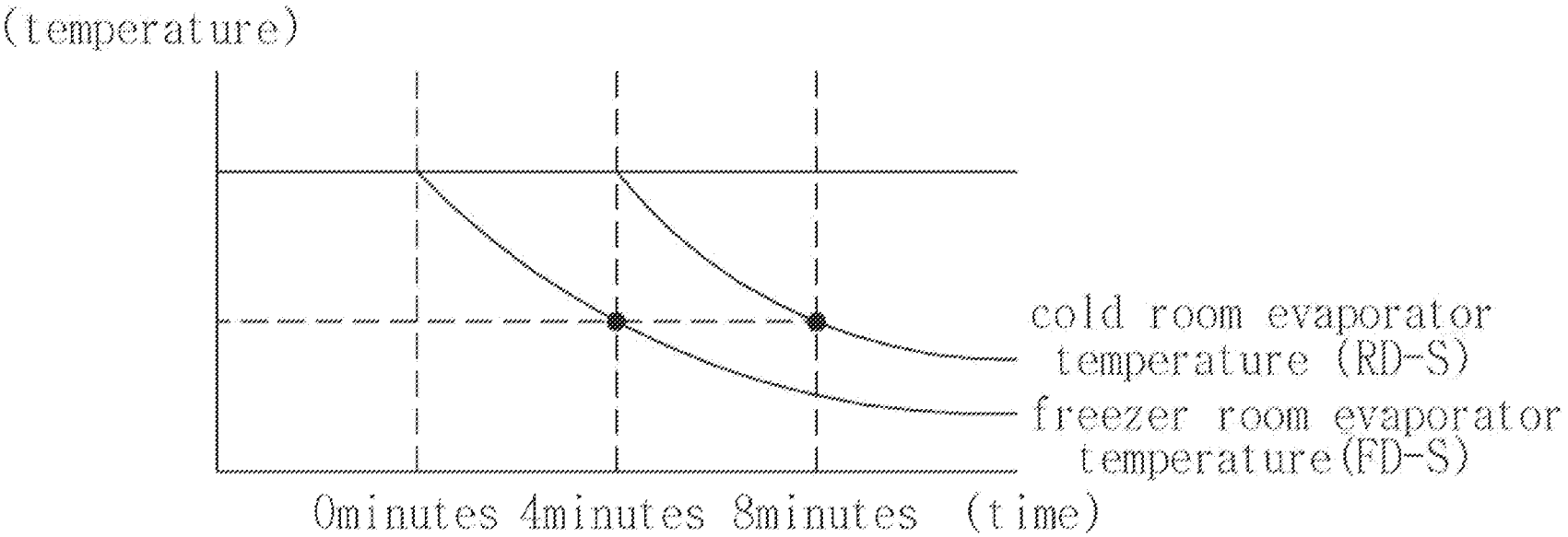
FIG. 4 is a graph showing normal rates of temperature change with respect to time in the refrigeration cycle of the refrigerator according to the present invention.
Figure 5:
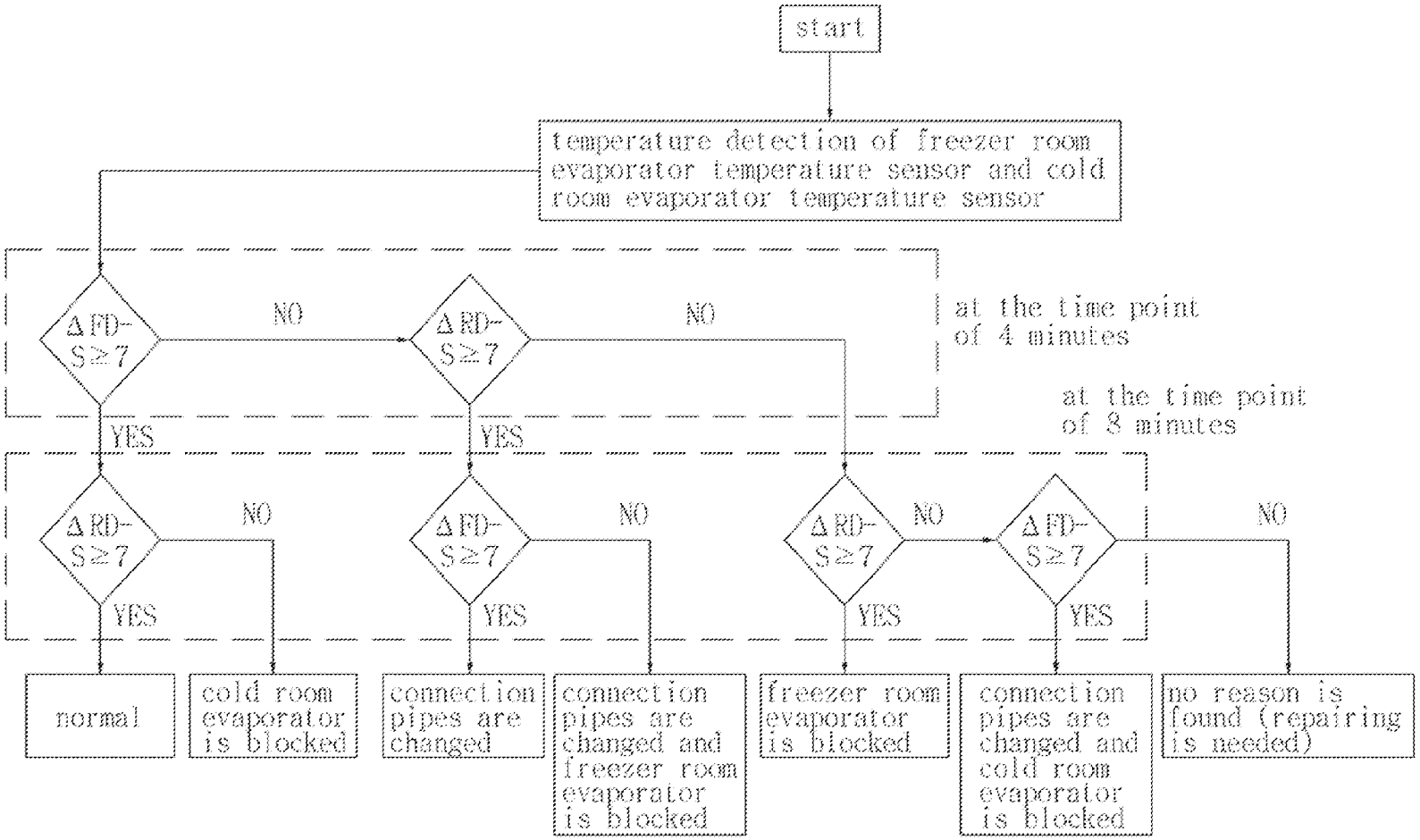
FIG. 5 is a flow chart showing a method for detecting an abnormality in a refrigeration cycle of a refrigerator according to the present invention.

FIG. 2 is a block diagram showing a refrigeration cycle in a refrigerator adopted to the present invention, FIG. 3 is a block diagram showing a device for detecting an abnormality in a refrigeration cycle of a refrigerator according to the present invention, FIG. 4 is a graph showing normal rates of temperature change with respect to time in the refrigeration cycle of the refrigerator according to the present invention, and FIG. 5 is a flow chart showing a method for detecting an abnormality in a refrigeration cycle of a refrigerator according to the present invention.

First, the refrigeration cycle abnormality of a refrigerator, and especially the connection state of outlet pipes of a refrigerant passage valve 500 and capillary tubes of an evaporator 100, should be basically checked.

That is, it is very important to detect whether the connection pipes between the outlet pipes of the refrigerant passage valve 500 and the capillary tubes of the evaporator 100 are switched and whether they are blocked due to frost.

To detect the abnormality of the refrigeration cycle of a refrigerator, as shown in FIG. 3, a freezer evaporator temperature sensor (FD-S) 11 and a cold room evaporator temperature sensor (RD-S) 12, which have a type of a defrost sensor detecting the temperature of the refrigerant ejected from the refrigerant passage valve 500, are mounted on the connection pipes between the outlet pipes of the refrigerant passage valve 500 and the capillary tubes of the evaporator 100.

The freezer evaporator temperature sensor 11 and the cold room evaporator temperature sensor 12 detect the temperature of the refrigerant ejected from the refrigerant passage valve 500 during the refrigeration cycle and thus transmit the detected temperatures to a controller 20.

As shown in FIG. 4, the controller 20 compares the rates of the temperature change with respect to time detected by the respective temperature sensors with the rates of the temperature change with respect to time in a freezer evaporator 110 and a cold room evaporator 120 and determines whether the compared rates correspond to each other.

In more detail, if power is applied to the refrigerator, using the controller 20, the ejection time of the refrigerant from the refrigerant passage valve 500 to the freezer evaporator 110 is set differently from that of the cold room evaporator 120, thereby detecting the rates of temperature change with respect to time measured in the freezer evaporator 110 and the cold room evaporator 120.

That is, the refrigerant is ejected to the freezer evaporator 110 for a given period of time, and next, after the same period of time as the refrigerant ejection time to the freezer evaporator 110 has passed, the refrigerant is ejected at the same time to the freezer evaporator 110 and the cold room evaporator 120. Then, the rates of temperature change with respect to time measured in the freezer evaporator 110 and the cold room evaporator 120 are compared, to detect whether the connection pipes are switched and blocked.

In more detail, the temperature differences between the freezer evaporator 110 and the cold room evaporator 120 are calculated with respect to time, and the calculated rate with respect to time is compared to previously set rate with respect to time, as shown in FIG. 4.

A method for detecting an abnormality in a refrigeration cycle of a refrigerator according to the present invention will be explained with respect to FIG. 5.

If power is applied to a refrigerator, first, the ejection time of the refrigerant from the refrigerant passage valve 500 to the freezer evaporator 110 is set differently from that of the cold room evaporator 120.

For example, as shown in FIG. 5, the refrigerant is ejected to the freezer evaporator 110 for 4 minutes, and next, the refrigerant is ejected to the cold room evaporator 120 for 4 minutes.

After that, the temperature of the refrigerant is measured by the freezer evaporator temperature sensor 11 and the cold room evaporator temperature sensor 12.

For example, the different values of the temperatures measured by the freezer evaporator temperature sensor 11 and the cold room evaporator temperature sensor 12 at the time points when 4 minutes and 8 minutes have passed and the initial temperatures are detected.

If, at the time point when 4 minutes have passed, the temperature difference Δt detected by the freezer evaporator temperature sensor 11 is more than 7° C., and if at the time point when 8 minutes are passed, the temperature difference Δt detected by the cold room evaporator temperature sensor 12 is more than 7° C., the measured temperatures are determined to be in a normal state, as shown in the graph of FIG. 4.

Contrarily, if the temperature difference Δt detected by the cold room evaporator temperature sensor 12 is less than 7° C., it can be determined that the cold room evaporator 120 is blocked.

On the other hand, at the time point when 4 minutes have passed, the temperature difference Δt detected by the freezer evaporator temperature sensor 11 is less than 7° C., and at the same time, the temperature difference Δt detected by the cold room evaporator temperature sensor 12 is more than 7° C., the measured temperatures are determined to be in an abnormal state when compared with the graph as shown in FIG. 4.

When the temperature detected by the cold room evaporator temperature sensor 12 is in the abnormal state, the difference between the temperature measured by the freezer evaporator temperature sensor 11 and the initial temperature is detected at the time point when 8 minutes have passed.

In this case, at the time point when 8 minutes have passed, if the temperature difference Δt detected by the freezer evaporator temperature sensor 11 is more than 7° C., the connection pipes are determined to be switched when compared with the graph as shown in FIG. 4.

Contrarily, at the time point when 8 minutes have passed, if the temperature difference Δt detected by the freezer evaporator temperature sensor 11 is less than 7° C., it can be determined that the connection pipes are switched, and at the same time, the freezer evaporator 110 is blocked.

On the other hand, at the time point when 4 minutes have passed, if the temperature difference Δt detected by the freezer evaporator temperature sensor 11 is less than 7° C., and at the same time, the temperature difference Δt detected by the cold room evaporator temperature sensor 12 is less than 7° C., the measured temperatures are in an abnormal state, when compared with the graph as shown in FIG. 4.

In this case, at the time point when 8 minutes have passed, if the temperature difference Δt detected by the cold room evaporator temperature sensor 12 is more than 7° C., the freezer evaporator 110 is determined to be blocked when compared with the graph as shown in FIG. 4.

Contrarily, at the time point when 8 minutes have passed, if the temperature difference Δt detected by the cold room evaporator temperature sensor 12 is less than 7° C., and at the same time, the temperature difference Δt detected by the freezer evaporator temperature sensor 11 is more than 7° C., it can be determined that the connection pipes are switched, and at the same time, the cold room evaporator 120 is blocked.

In the present disclosure, the above-mentioned temperature and time conditions are not principal characteristics of the present invention, and various conditions different from the control logic shown may be effective.

In this case, as shown in FIG. 4, the control logic is based on a graph plotting temperature against time and stored previously in a program, and accordingly, the temperatures detected by the freezer evaporator temperature sensor 11 and the cold room evaporator temperature sensor 12 are compared with the previously set rates of temperature change with respect to time in the freezer evaporator 110 and the cold room evaporator 120, thereby determining whether the compared rates correspond to each other.

Accordingly, the temperature values measured by the freezer evaporator temperature sensor 11 and the cold room evaporator temperature sensor 12 are compared with the reference temperature values previously set through the controller 20, thereby easily detecting various abnormal states occurring in the refrigeration cycle.

While the present invention has been described with reference to particular illustrative embodiments, it is not to be restricted by the embodiments, but only by the appended claims. It is to be appreciated that those skilled in the art can change or modify the embodiments without departing from the scope and spirit of the present invention.

The invention claimed is:

1. A method for detecting an abnormality in a refrigeration cycle of a refrigerator, the method comprising the steps of:

(a) if power is applied to a refrigerator, setting an ejection time of refrigerant from a refrigerant passage valve to a freezer evaporator differently from the refrigerant passage valve to a cold room evaporator;

(b) calculating rates of temperature change with respect to time measured in the freezer evaporator and the cold room evaporator; and (c) comparing the calculated rates of temperature change with previously set rates of temperature change with respect to time in the freezer evaporator and the cold room evaporator and determining whether the abnormality of the refrigeration cycle exists, wherein the step (a) comprises the steps of ejecting the refrigerant to the freezer evaporator for a given period of time and after the same period of time as the refrigerant ejection time to the freezer evaporator has passed, ejecting the refrigerant at the same time to the freezer evaporator and the cold room evaporator.

2. The method according to claim 1, wherein at the time point when the given period of time has passed, if a temperature difference between the temperature measured by a freezer evaporator temperature sensor and an initial temperature is more than a set temperature, and at the time point when the same time as the given period of time has passed, if a temperature difference between the temperature measured by a cold room evaporator temperature sensor and the initial temperature is more than the set temperature, it is determined that the refrigeration cycle for the refrigerator is in a normal state.

3. The method according to claim 1, wherein at the time point when the given period of time has passed, if a temperature difference between the temperature measured by the freezer evaporator temperature sensor and the initial temperature is more than the set temperature, and at the time point when the same time as the given period of time has passed, if a temperature difference between the temperature measured by the cold room evaporator temperature sensor and the initial temperature is less than the set temperature, it is determined that the cold room evaporator is blocked.

4. The method according to claim 1, wherein at the time point when the given period of time has passed, if a temperature difference between the temperature measured by the freezer evaporator temperature sensor and the initial temperature is less than the set temperature, it is determined that the refrigeration cycle for the refrigerator is in an abnormal state.

5. The method according to claim 4, wherein at the time point when the same time as the given period of time has passed, if a temperature difference between the temperature measured by the freezer evaporator temperature sensor and the initial temperature is more than the set temperature, it is determined that connection pipes are switched, and if the temperature difference thereof is less than the set temperature, it is determined that the freezer evaporator is blocked.

6. The method according to claim 4, wherein at the time point when the same time as the given period of time has passed, if a temperature difference between the temperature measured by the cold room evaporator temperature sensor and the initial temperature is more than the set temperature, it is determined that the freezer evaporator is blocked, and if the temperature difference thereof is less than the set temperature, it is determined that the connection pipes are switched and the cold room evaporator is blocked or no reason is found.

* * * * *